US009601877B2

(12) United States Patent
Yang et al.

(10) Patent No.: US 9,601,877 B2
(45) Date of Patent: Mar. 21, 2017

(54) CONNECTOR HOUSING

(71) Applicant: Tyco Electronics (Shanghai) Co. Ltd., Shanghai (CN)

(72) Inventors: Hongwen Yang, Shanghai (CN); Jian Zhou, Shanghai (CN); Weixiang Ding, Shanghai (CN); Yangrong Xue, Shanghai (CN); Jingwei Shao, Shanghai (CN); Xinbo Liu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 82 days.

(21) Appl. No.: 14/741,811

(22) Filed: Jun. 17, 2015

(65) Prior Publication Data

US 2015/0364869 A1 Dec. 17, 2015

(30) Foreign Application Priority Data

Jun. 17, 2014 (CN) ..... 2014 2 0323359 U

(51) Int. Cl.
*H01R 13/6587* (2011.01)
*H01R 13/659* (2011.01)

(52) U.S. Cl.
CPC ..... *H01R 13/659* (2013.01)

(58) Field of Classification Search
CPC ..... H01R 13/6587; H01R 13/6586; H01R 13/658; H05K 9/0058; H05K 9/002; H05K 9/0007; H05K 9/0083; H05K 9/0084; H05K 9/0088
USPC ..... 439/607.21, 607.2; 174/355, 390, 369, 174/385, 386, 50, 520, 535, 559–562, 174/356, 258, 377, 368; 361/704, 715, 361/729
See application file for complete search history.

(56) References Cited

U.S. PATENT DOCUMENTS 6,724,641 B1 * 4/2004 Hwang ..... G02B 6/4277 174/387
6,878,872 B2 * 4/2005 Lloyd ..... G02B 6/4277 174/366
7,612,299 B2 * 11/2009 Chen ..... H05K 9/0058 174/359
7,869,224 B1 * 1/2011 Yang ..... G02B 6/4284 174/350
8,182,290 B2 * 5/2012 Fonteneau ..... H05K 9/0058 439/607.21
8,203,084 B2 * 6/2012 Wertz, Jr. ..... H01R 13/6584 174/368
8,426,751 B2 * 4/2013 Lee ..... H01R 13/506 174/520

(Continued)

*Primary Examiner* — Gary Paumen
(74) *Attorney, Agent, or Firm* — Barley Snyder

(57) ABSTRACT

A connector housing is provided and includes a single sheet of material having a top wall, a pair of side walls, rear end wall, a bottom wall, and a pair of partition members. The bottom wall includes a first bottom wall portion integrally connected with one of the pair of side walls, a second bottom wall portion integrally connected with the other of the pair of side walls, and a third bottom wall portion separated from and assembled to the first and second bottom wall portions. The pair of partition members is disposed between the top wall and the bottom wall to divide an inner receiving space that is defined by the top wall, the pair of side walls and the bottom wall into three insertion ports.

21 Claims, 5 Drawing Sheets

(56) References Cited

U.S. PATENT DOCUMENTS

| | | | | |
|---|---|---|---|---|
| 8,449,331 | B2 * | 5/2013 | Phillips | H01R 13/6581 361/704 |
| 8,613,632 | B1 * | 12/2013 | Nichols | H01R 13/6587 439/485 |
| 8,797,736 | B2 * | 8/2014 | Zhu | G06F 1/187 174/535 |
| 9,035,199 | B2 * | 5/2015 | Janota | H05K 9/0007 174/355 |
| 2004/0246693 | A1 * | 12/2004 | Lloyd | H01R 13/65802 361/800 |
| 2015/0072561 | A1 * | 3/2015 | Schmitt | H01R 13/6587 439/607.55 |

* cited by examiner

CONNECTOR HOUSING

CROSS-REFERENCE TO RELATED APPLICATION

This application claims the benefit of the filing date under 35 U.S.C §119(a)-(d) to Chinese Patent Application No. 201420323359.8 filed on Jun. 17, 2014.

FIELD OF THE INVENTION

The invention relates to a connector housing and, more particularly, to a connector housing for outer shielding.

BACKGROUND

A known connector housing is shown in FIGS. 1 and 2, and generally includes an upper housing 10, a lower housing 20, and two partition members 30. As shown, the upper housing 10, the lower housing 20 and the two partition members 30 are individual pieces separated from one another. An inner receiving space of the connector housing is divided into three insertion ports, which are disposed side by side in the same layer, by two partition members 30.

Overall, such a design requires too many individual pieces, the number of which reaches up to N+1 for the connector housing with 1×N ports (N is an integer greater than 1), i.e., one upper housing 10, one lower housing 20 and two partition members 30, as shown in FIGS. 1 and 2.

These known connector housings (also named as a connector cage or a shielding housing of a connector), which have the upper housing 10, the lower housing 20, and partition members 30 separated from one another, generally have poor structural strength that may lead to structural cracks. Furthermore, if the insertion port has a parallelogram configuration, and four side walls forming the parallelogram constitute separate four-part configuration, connector housing exhibits a parallelogram effect, i.e., the ports of the connector housing swing towards two sides of the connector housing. Also, it is hard to control the dimension of each member with respect to assembling the connector housing. In addition, a rubber shield ring may be scratched due to sharp protrusions apt to be formed on the ports of the connector housing.

Furthermore, complex steps are required to assemble the upper housing 10, the lower housing 20 and the partition members 30, which are separated from one another, which results in poor manufacturing efficiency and difficulty in achieving efficient automatic machining process.

Furthermore, during manufacturing the connector housing, complex steps are required to assemble the upper housing 10, the lower housing 20 and the plurality of individual partition members 30, which are separated from one another. As a result, manufacturing efficiency is low, and it is hard to achieve efficient automatic machining process.

SUMMARY

According to one aspect of the present invention, a connector housing is provided and includes a single sheet of material having a top wall, a pair of side walls, rear end wall, a bottom wall, and a pair of partition members. The bottom wall includes a first bottom wall portion integrally connected with one of the pair of side walls, a second bottom wall portion integrally connected with the other of the pair of side walls, and a third bottom wall portion separated from and assembled to the first and second bottom wall portions. The pair of partition members is disposed between the top wall and the bottom wall to divide an inner receiving space that is defined by the top wall, the pair of side walls and the bottom wall into three insertion ports.

BRIEF DESCRIPTION OF THE DRAWINGS

The invention will be explained in greater detail in the following with reference to embodiments, referring to the appended drawings, in which.

DETAILED DESCRIPTION OF THE EMBODIMENT(S)

Figure 1:
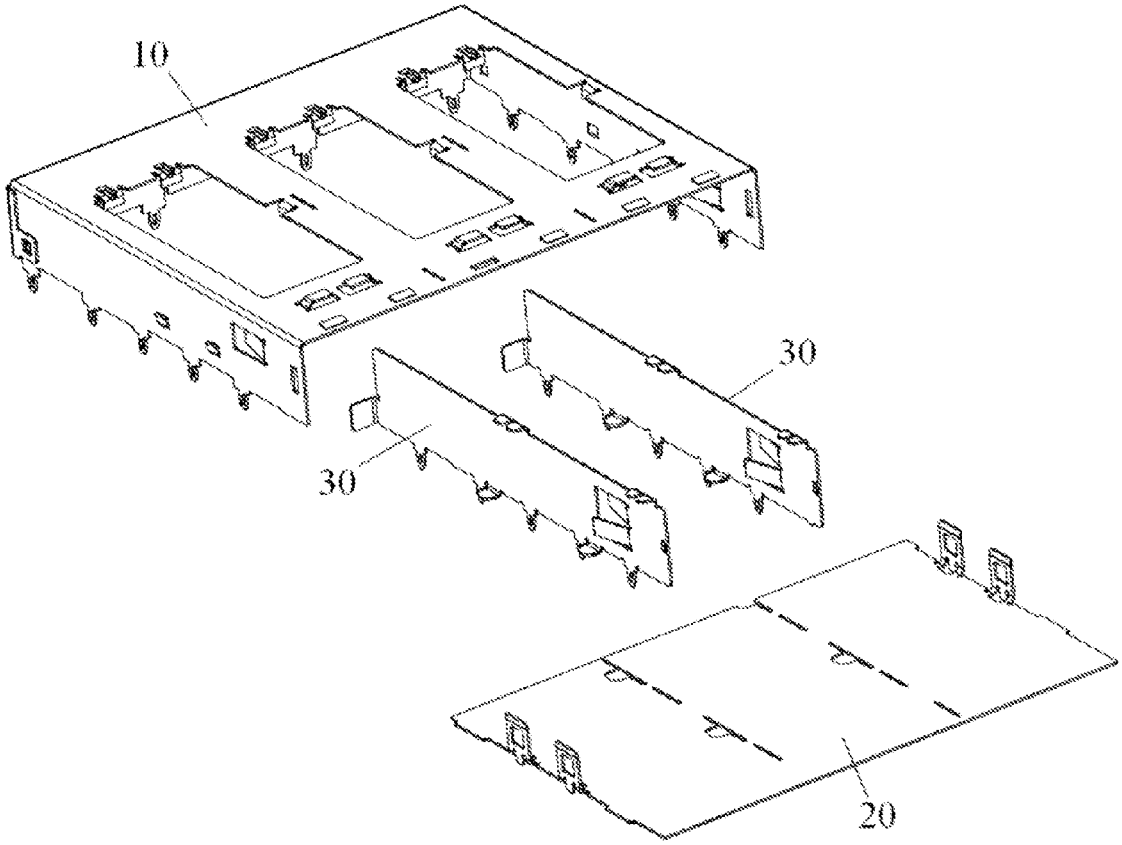
FIGURE 1 PRIOR ART
FIG. 1 is a perspective view of a known connector housing.
Figure 2:
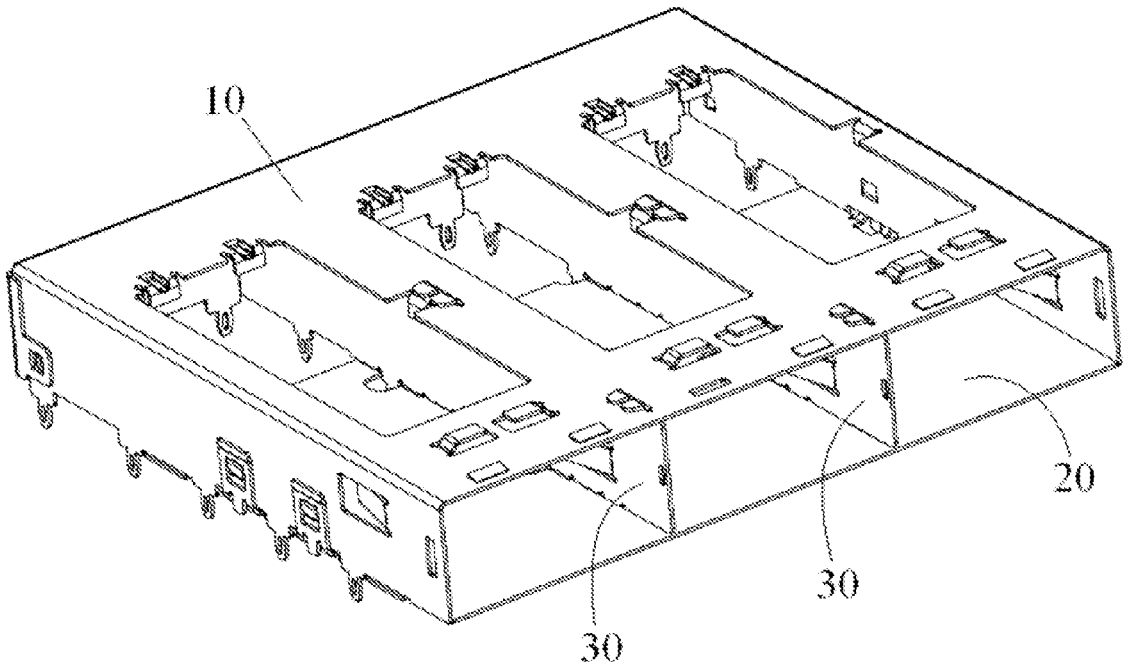
FIGURE 2 PRIOR ART
FIG. 2 is an exploded view of the known connector housing of FIG. 1.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 3:
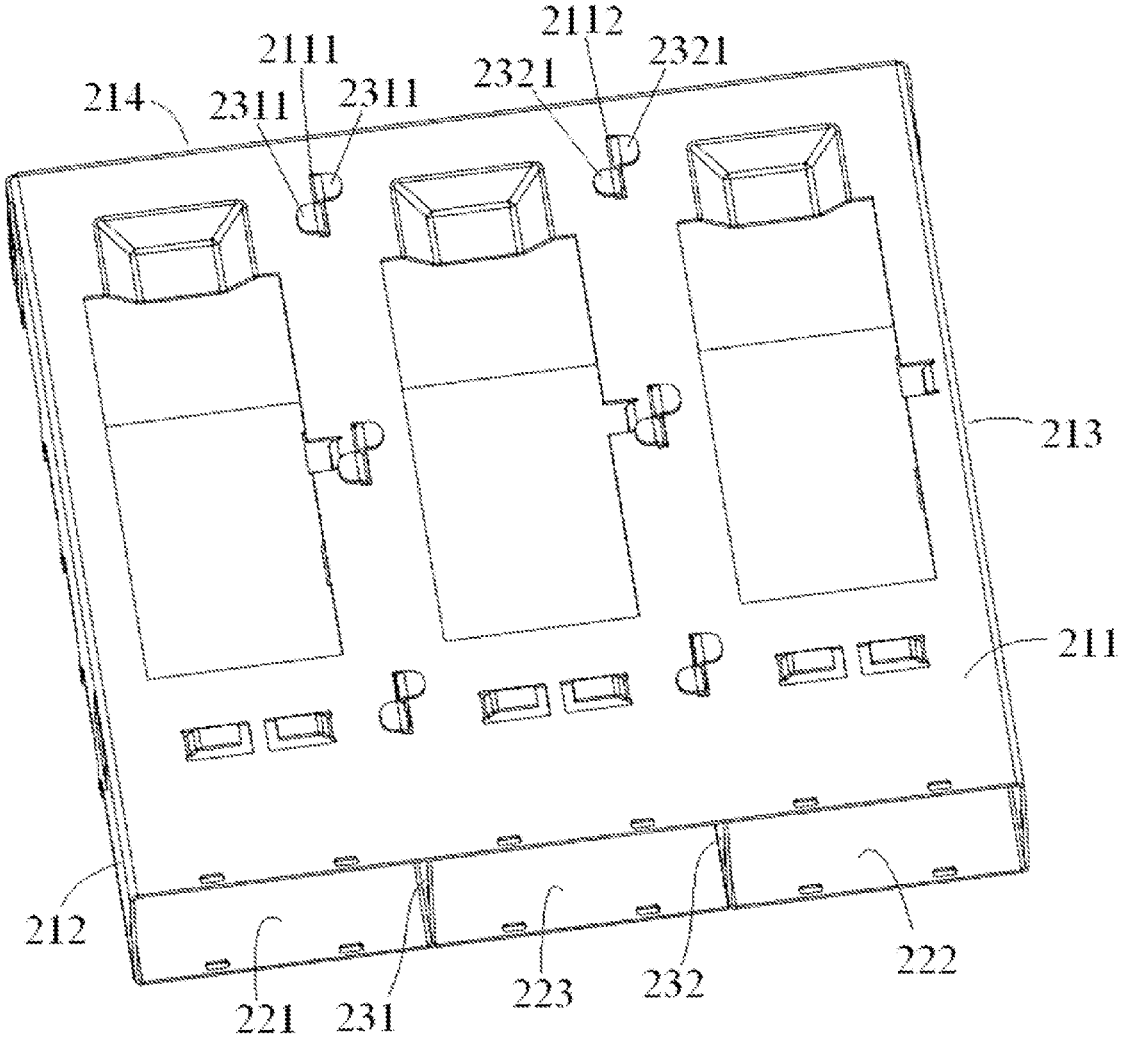
FIG. 3 is a perspective view of a connector housing with three insertion ports according to the invention.

According to a general concept of the present invention, as shown in FIG. 3, a connector housing, according to the invention, generally includes a top wall 211, a pair of side walls 212, 213, a rear end wall 214, a bottom wall 221, 222, 223, and two partition members 231, 232 disposed between the top wall 211 and the bottom wall 221, 222, 223 to divide an inner receiving space defined by the top wall, the pair of side wall and the bottom wall into three insertion ports.

In the embodiment shown in FIG. 3, three insertion ports are disposed side by side in the same layer and extend in a longitudinal direction parallel with the top wall or bottom wall of the connector housing.

Figure 4:
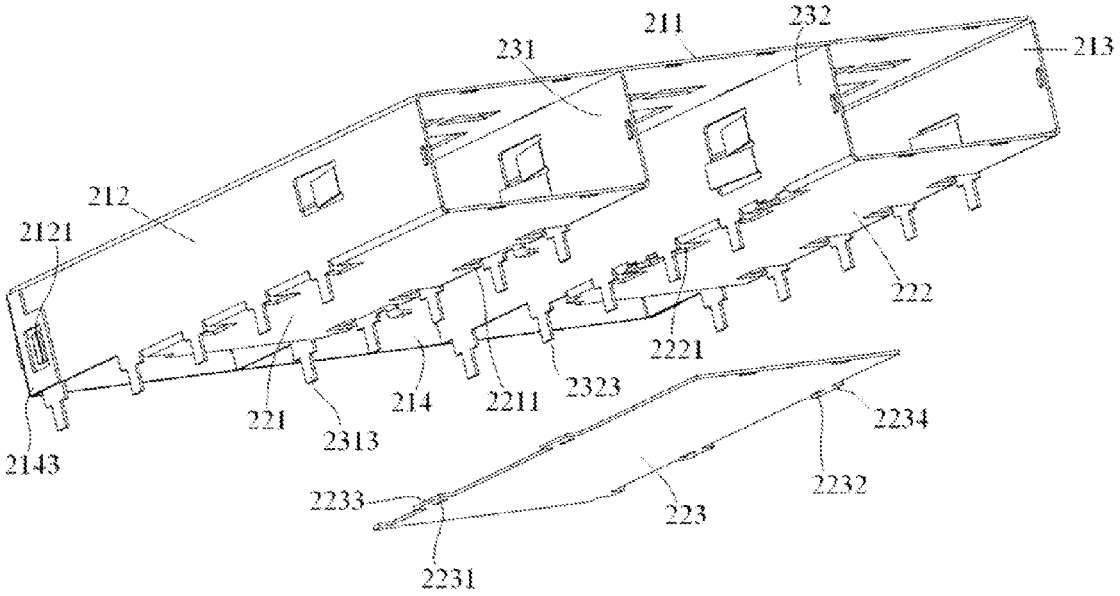
FIG. 4 is a exploded perspective view of the connector housing of FIG. 3.
Figure 5:
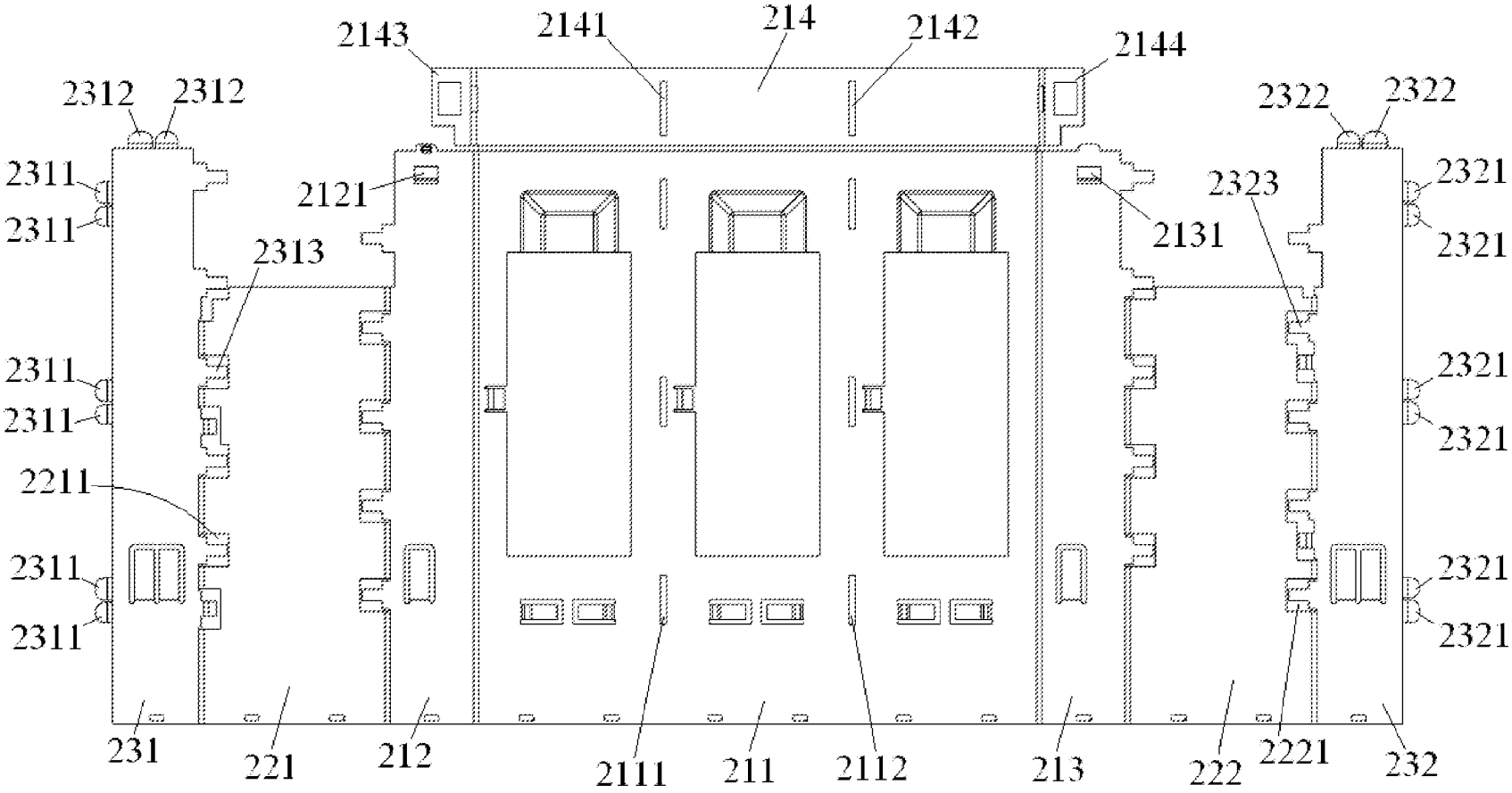
FIG. 5 is a top plan view of a main plate that forms the connector housing of FIG. 4.

As shown in FIGS. 3 4 and 5, the bottom wall 221, 222, 223 includes a first bottom wall portion 221 integrally connected between one of the pair of side walls 212 and one of two partition members 231, a second bottom wall portion 222 integrally connected between the other of the pair of side walls 213 and the other of two partition members 232, and a third bottom wall portion 223, which is an individual piece separated from the first and second bottom wall portions 221, 222.

As shown in FIGS. 3 4 and 5, in the embodiment illustrated, the top wall 211, the pair of side walls 212, 213, the rear end wall 214, the first bottom wall portion 221, the second bottom wall portion 222 and two partition members 231, 232 are formed into a single piece.

As shown in FIGS. 4 and 5, a plurality of insertion pin receiving passageways 2231 are provided along one longitudinal edge portion of the third bottom wall portion 223. A plurality of insertion pins 2313 are provided on a lower edge portion of the partition member 231 adjacent to the bottom wall of the connector housing. The plurality of insertion pins 2313 are to be inserted into a plurality of insertion pin receiving passageways 2231 of the third bottom wall portion 223 respectively. Similarly, a plurality of insertion pin receiving passageways 2232 are provided along the other longitudinal edge portion of the third bottom wall portion 223. A plurality of insertion pins 2323 are provided along a lower edge portion of the partition member 232 adjacent to the bottom wall of the connector housing. The plurality of insertion pins 2323 are to be inserted into a plurality of insertion pin receiving passageways 2232 of the third bottom wall portion 223 respectively. Thus, the third bottom wall portion 223 is assembled to the first and second bottom wall portions 221, 222, and the third bottom wall portion 223 together with the first and second bottom wall portions 221, 222 form the whole bottom wall of the connector housing.

In the shown embodiment of FIGS. 3-5, since the whole connector housing is formed by only two separate pieces, structure strength of the whole connector housing is improved, and dimension accuracy of each insertion port is reliably ensured.

As shown in FIG. 4, the plurality of insertion pins 2313, 2323 pass through a plurality of insertion pin receiving passageways 2231, 2232, respectively, and are then inserted into a circuit board (not shown) for mounting the connector housing. Thus, the insertion pins for mounting the connector housing may be used to assemble the third bottom wall portion 223 with the first and second bottom wall portions 221, 222, without requiring any additional individual connection members for assembling the third bottom wall portion 223 with the first and second bottom wall portions 221, 222. As a result, such a design saves material and increases manufacturing efficiency.

Now referring to FIGS. 4 and 5, in the shown embodiment, a plurality of tabs 2233, 2234 are provided on each longitudinal edge portion of the third bottom wall portion 223. The plurality of insertion pin receiving passageways 2231, 2232 are formed in the plurality of tabs 2233, 2234. Furthermore, a plurality of tab receiving passageways 2211, 2221 are provided in longitudinal edge portions of the first and second bottom wall portions 221, 222 adjacent to the third bottom wall portion 223.

Although not shown, it will be appreciated that, the plurality of tabs 2233, 2234 of the third bottom wall portion 223 may be mated with the plurality of tab receiving passageways 2211, 2221 formed in the first and second bottom wall portions 221, 222 when the third bottom wall portion 223 is assembled to the first and second bottom wall portions 221, 222.

In the embodiment shown in FIGS. 4 and 5, the plurality of tabs 2233, 2234 are approximately rectangle shape, and have shapes and sizes approximately identical to each other. Similarly, in the embodiment shown in FIGS. 4 and 5, the plurality of tab receiving passageways 2211, 2221 are approximately rectangle shaped, and have shapes and sizes approximately identical to each other.

However, the present invention is not limited to this, and in another embodiment of the present invention, the plurality of tabs 2233, 2234 may be dovetail tabs, and the plurality of tab receiving passageways 2211, 2221 may be formed as dovetail tab receiving passageways. Accordingly, when connected, the plurality of dovetail tabs with the plurality of dovetail tab receiving passageways, respectively, provide strength between the third bottom wall portion 223 and the first and second bottom wall portions 221, 222 and prevent movement of the third bottom wall portion 223 relative to the first and second bottom wall portions 221, 222.

In a further embodiment of the invention, at least two of the plurality of dovetail tabs may have shapes and/or sizes different from each other; and at least two of the plurality of dovetail tab receiving passageways may have shapes and/or sizes different from each other. Thus, during engagement between various dovetail tabs with different shapes and/or sizes and various dovetail tab receiving passageways with different shapes and/or sizes, structural strength between the third bottom wall portion 223 and the first and second bottom wall portions 221, 222 may be further improved to further prevent movement of the third bottom wall portion 223 relative to the first and second bottom wall portions 221, 222.

As shown in FIGS. 3 and 5, a plurality of pairs of first bendable connection lugs 2311, 2311 are provided on the upper edge portion of one of two partition members 231 adjacent to the top wall 211. A plurality of first lug receiving passageways 2111 are provided along the top wall 211 and are to be mated with mated with the plurality of pairs of first bendable connection lugs 2311, 2311. As clearly shown in FIG. 3, each pair of first bendable connection lugs 2311, 2311 pass through one corresponding first lug receiving passageway 2111, and are then bent to be pressed against an outer surface of the top wall 211, to connect the partition member 231 to the top wall 211.

Similarly, as shown in FIGS. 3 and 5, in the shown embodiment, a plurality of pairs of first bendable connection lugs 2321, 2321 are provided on the upper edge portion of the other of two partition members 232 adjacent to the top wall 211. A plurality of first lug receiving passageways 2112 are provided in the top wall 211 and to be mated with the plurality of pairs of first bendable connection lugs 2321, 2321. As clearly shown in FIG. 3, each pair of first bendable connection lugs 2321, 2321 pass through one corresponding first lug receiving passageway 2112, and are then bent to be pressed against the outer surface of the top wall 211, to connect the partition member 232 to the top wall 211.

As shown in FIGS. 3 and 5, each pair of first bendable connection lugs 2311, 2311 of the partition member 231 are bent in opposite directions. Similarly, each pair of first bendable connection lugs 2321, 2321 of the partition member 232 are also bent in opposite directions. Thus, connection strength and structure stability between the partition members 231, 232 and the top wall 211 may be improved by bending each pair of first bendable connection lugs in the opposite directions.

As shown in FIGS. 3 and 5, the plurality of pairs of first bendable connection lugs 2311, 2321 of the partition members 231, 232 are regularly spaced from each other.

As shown in FIG. 5, a pair of second bendable connection lugs 2312, 2312 are provided on one end of one of two partition members 231 adjacent to the rear end wall 214. A second lug receiving passageway 2141 is provided in the rear end wall 214 and is to be mated with the pair of second bendable connection lugs 2312, 2312. The pair of second bendable connection lugs 2312, 2312 passes through the corresponding second lug receiving passageway 2141, and are then bent to be pressed against an outer surface of the rear end wall 214, to connect the partition member 231 to the rear end wall 214.

Similarly, as shown in FIG. 5, a pair of second bendable connection lugs 2322, 2322 are provided on one end of the other of two partition members 232 adjacent to the rear end wall 214. A second lug receiving passageway 2142 is provided in the rear end wall 214 and is to be mated with the pair of second bendable connection lugs 2322, 2322. The pair of second bendable connection lugs 2322, 2322 passes through the corresponding second lug receiving passageway 2142, and are then bent to be pressed against the outer surface of the rear end wall 214, to connect the partition member 232 to the rear end wall 214.

Although not shown, each pair of second bendable connection lugs 2312, 2312 of the partition member 231 are bent in opposite directions. Similarly, each pair of second bendable connection lugs 2322, 2322 of the partition member 232 are also bent in opposite directions. Thus, connection strength and structure stability between the partition members 231, 232 and the rear end wall 214 may be improved by bending each pair of second bendable connection lugs in the opposite directions.

As shown in FIGS. 4 and 5, a protrusion 2121 is formed on one end of one side wall 212 adjacent to the rear end wall 214. A bendable connection piece is provided on one end of the rear end wall 214 adjacent to the one side wall 212. The connection piece is bent and then snap-fit with the protrusion 2121 by a protrusion receiving passageway 2143 formed in the connection piece, to connect the one side wall 212 to the rear end wall 214.

Similarly, as shown in FIGS. 4 and 5, a protrusion 2131 is formed on one end of the other side wall 213 adjacent to the rear end wall 214. A bendable connection piece is provided on one end of the rear end wall 214 adjacent to the other side wall 213. The connection piece is bent and then snap-fit with the protrusion 2131 by a protrusion receiving passageway 2144 formed in the connection piece, to connect the other side wall 213 to the rear end wall 214.

In the shown embodiment, the whole connector housing except the third bottom wall portion 223 is made of a single plate of material, as shown in FIG. 5.

The single plate, as shown in FIG. 5, may be formed by punching at one time, i.e., a piece of raw plate may be punched at one time to form the top wall 211, the pair of side walls 212, 213, the rear end wall 214, the first bottom wall portion 221, the second bottom wall portion 222 and two partition members 231, 232 of the whole connector housing. Thus the invention simplifies the manufacturing and assembling processes, improves level of automation, facilitates mass production, and improves manufacturing efficiency.

The connector housing according to the invention has less separate structural pieces. Overall, in the connector housing, assembly is simplified by facilitating automatic assembly, the cost of manufacturing the connector housing is reduced, high strength and well stability of the connector housing is achieved.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector housing, comprising:

a single sheet of material, having:

a top wall;

a pair of side walls;

a rear end wall;

a bottom wall having a first bottom wall portion integrally connected with one of the pair of side walls, a second bottom wall portion integrally connected with the other of the pair of side walls, and a third bottom wall portion separated from and assembled to the first and second bottom wall portions; and a pair of partition members disposed between the top wall and the bottom wall to divide an inner receiving space defined by the top wall, the pair of side walls and the bottom wall into three insertion ports.

2. The connector housing according to claim 1, further comprising a plurality of insertion pin receiving passageways disposed along a longitudinal edge of the third bottom wall portion.

3. The connector housing according to claim 2, further comprising a plurality of insertion pins disposed on a lower edge of each partition member of the pair of partition members and corresponding to the plurality of insertion pin receiving passageways.

4. The connector housing according to claim 3, wherein the plurality of insertion pins pass through the plurality of insertion pin receiving passageways.

5. The connector housing according to claim 4, further comprising a plurality of tabs disposed on the longitudinal edge of the third bottom wall portion.

6. The connector housing according to claim 5, further comprising a plurality of tab receiving passageways disposed along longitudinal edges of the first and second bottom wall portions and positioned adjacent to the third bottom wall portion.

7. The connector housing according to claim 6, wherein the plurality of tabs are dovetail tabs and the plurality of tab receiving passageways are keyed to the dovetail tabs.

8. The connector housing according to claim 7, wherein at least two dovetail tabs are shaped or sized differently from each other.

9. The connector housing according to claim 8, wherein at least two dovetail receiving passageways are shaped or sized differently from each other.

10. The connector housing according to claim 1, further comprising a plurality of first bendable connection lugs disposed on upper edge portions of the pair of partition members.

11. The connector housing according to claim 10, further comprising a plurality of first lug receiving passageways provided along the top wall and keyed to mate with the plurality of first bendable connection lugs.

12. The connector housing according to claim 11, wherein a pair of the plurality of first bendable connection lugs pass through a corresponding first lug receiving passageway of the plurality of first lug receiving passageways, and is then bent to press against an outer surface of the top wall.

13. The connector housing according to claim 12, wherein the pair of first bendable connection lugs is bent in opposite directions from another pair.

14. The connector housing according to claim 13, wherein the plurality of first bendable connection lugs are regularly spaced from each other.

15. The connector housing according to claim 14, further comprising a plurality of second lug receiving passageways provided along ends of each partition member of the pair of partition members and positioned adjacent to the rear end wall.

16. The connector housing according to claim 15, wherein the plurality of second lug receiving passageways are keyed to mate with a plurality of second bendable connection lugs.

17. The connector housing according to claim 16, wherein a pair of the plurality of second bendable connection lugs pass through a corresponding second lug receiving passageway of the plurality of second lug receiving passageways, and is then bent to press against the outer surface of the top wall.

18. The connector housing according to claim 17, wherein the pair of second bendable connection lugs is bent in an opposite direction to another pair.

19. The connector housing according to claim 18, further comprising a protrusion disposed on an end of each side wall of the pair of sidewalls and positioned adjacent to the rear end wall.

20. The connector housing according to claim 1, wherein the single sheet of material is metal.

21. The connector housing according to claim 20, wherein the single sheet of material is formed by one punching process.

* * * * *